US012066183B1

(12) United States Patent
Rao et al.

(10) Patent No.: US 12,066,183 B1
(45) Date of Patent: Aug. 20, 2024

(54) STEAM GENERATION SYSTEM WITH SUBCOOLED WATER SPRAY FOR WELLBORE STEAM INJECTION

(71) Applicant: En-Fab Inc., Houstion, TX (US)

(72) Inventors: Thanneeru D. Rao, Katy, TX (US); Mayur Borad, Houston, TX (US); Abdulla Khalifa Khamis Al Hinai, Seeb (OM); Dane Anderson, Bakersfield, CA (US)

(73) Assignee: En-Fab Inc., Houston, TX (US)

( * ) Notice: Subject to any disclaimer, the term of this patent is extended or adjusted under 35 U.S.C. 154(b) by 0 days.

(21) Appl. No.: 18/435,142

(22) Filed: Feb. 7, 2024

Related U.S. Application Data

(62) Division of application No. 18/365,553, filed on Aug. 4, 2023, now Pat. No. 11,959,633.

(60) Provisional application No. 63/483,600, filed on Feb. 7, 2023.

(51) Int. Cl.

| | |
|---|---|
| ***F22B 35/18*** | (2006.01) |
| ***E21B 7/06*** | (2006.01) |
| ***E21B 43/24*** | (2006.01) |
| ***F22B 35/00*** | (2006.01) |
| ***F22G 5/12*** | (2006.01) |
| *E21B 37/06* | (2006.01) |

(52) U.S. Cl.
CPC ..... *F22B 35/18* (2013.01); *E21B 43/24* (2013.01); *F22B 35/005* (2013.01); *F22G 5/123* (2013.01); *E21B 37/06* (2013.01)

(58) Field of Classification Search
CPC ..... F22B 35/18; F22B 35/005; E21B 43/24; E21B 37/06; F22G 5/123
See application file for complete search history.

(56) References Cited

U.S. PATENT DOCUMENTS 4,498,542 A * 2/1985 Eisenhawer ..... F22B 1/26 166/57
4,807,701 A * 2/1989 Hall ..... E21B 43/24 166/57

(Continued)

FOREIGN PATENT DOCUMENTS

CN 101298911 A * 11/2008

OTHER PUBLICATIONS

Dou, CN101298911 and translation (Year: 2008).*

*Primary Examiner* — Steven S Anderson, II
(74) *Attorney, Agent, or Firm* — Haynes and Boone, LLP

(57) ABSTRACT

A steam supply system having a wet steam source and a steam separator disposed to separated wet steam into dry saturated steam and a saturated condensate. The dry saturated steam is heated in a superheater to produce superheated steam, while the saturated condensate is cooled in a subcooler to produced subcooled condensate with a target temperature selected to prevent immediate evaporation of the subcooled condensate when mixed with the superheated steam. The subcooled condensate is sprayed into a stream of superheated steam using spray nozzles and gradually evaporates downstream of the spray nozzles to produce process steam of a desired % quality. A cooling fluid passing through the subcooler is utilized to cool the saturated condensate. The flow rate of the cooling fluid through the subcooler can be utilized to achieve process steam of a desired % quality.

16 Claims, 4 Drawing Sheets

(56) References Cited

U.S. PATENT DOCUMENTS

| | | | | |
|---|---|---|---|---|
| 2006/0076428 | A1* | 4/2006 | Knight | F22D 1/36<br>237/19 |
| 2014/0216717 | A1* | 8/2014 | O'Donnell | H10N 10/13<br>166/90.1 |
| 2014/0262257 | A1* | 9/2014 | Costanzo | F22D 1/02<br>29/890.051 |

* cited by examiner

STEAM GENERATION SYSTEM WITH SUBCOOLED WATER SPRAY FOR WELLBORE STEAM INJECTION

PRIORITY CLAIM

This application is a divisional of U.S. patent application Ser. No. 18/365,553, filed Aug. 4, 2023, which claims the benefit of priority to U.S. Provisional Application No. 63/483,600, filed Feb. 7, 2023, the benefit of which is claimed and the disclosures of which are incorporated by reference in their entirety.

FIELD OF THE INVENTION

The present disclosure generally relates to production of steam for use in enhanced oil recovery operations, and more particularly, to the production of process steam having a high quality while minimizing scale formation during the production of the process steam.

BACKGROUND OF THE INVENTION

It is common in the oil and gas industry to inject steam into a wellbore as part of Enhanced Oil Recovery (EOR) operations. The steam for such EOR operations is usually produced by a once-through steam generator (OTSG), which, in its simplest form, is a continuous tube heat exchanger in which preheating and evaporation of feedwater takes place consecutively to produce a steam stream. Once the steam is produced by the OTSG, it may be prepared or enhanced prior to injection. For example, a steam separator may be utilized to separate the steam stream into gaseous water in the form of dry steam from liquid water in the form of condensate (or saturated water). Additionally, the temperature of the dray steam may be increased in a superheater to add heat, yielding superheated steam. As noted, an OTSG produces a steam stream having a gaseous water portion and a liquid water portion, where the term "steam quality" refers to the amount of liquid content in the produced steam such that the lower the water content, the higher the steam quality. In the steam separator, the gaseous water portion of the steam is separated from the liquid water portion of the steam, after which, the gaseous portion may be injected into a wellbore as part of EOR operations. In some cases, the gaseous portion of the steam may first be superheated before injection. Often, prior art OTSGs are limited to producing steam where the gaseous portion of the steam is limited to about 80% quality (weight %) steam or "wet" steam. 80% quality steam is comprised of 80 percent gas and 20 percent liquid water. The percent of water in steam will go down from 20% to only 5% when steam quality goes up from 80% to 95%. Although it is desirable for purposes of EOR applications to generate steam with a quality significantly higher than 80%, such as 95% quality steam or higher, such OTSGs are often limited to 80% because of the need to retain a certain amount of liquid in the steam for removal of solids, it being understood solids in the steam can damage the OTSG as well as EOR equipment such as superheaters and injection nozzles utilized in the operations. Therefore, because of the need to retain liquid water, only about 80% of the feedwater is allowed to vaporize in the OTSG in order to maintain some of the feedwater as liquid to retain water soluble solids in solution. By maintaining a sufficient quantity of such feedwater as liquid in the OTSG, precipitation of solids, and thus the likelihood of scale formation, particularly in the heating tubes of the OTSG, is minimized. But because of the need to retain approximately 20% liquid to maintain dissolved solids in solution, it is difficult to achieve steam of a quality significantly higher than 80%, unless the incoming feedwater has zero or negligible amount of total dissolved solids thus obviating the need to retain a portion, i.e., 20%, of the feedwater as liquid. Feedwater with negligible amounts of total dissolved solids is not typically feasible because water treatment costs to remove solids in order to achieve a higher quality steam are expensive, especially to produce sufficiently pure feedwater that would be suitable to generate dry steam in radiant section of a conventional OTSG.

With that said, higher quality (95% nominal quality) steam, such as dry steam or superheated steam, has some definite advantages over 80% quality wet steam for purposes of EOR operations. Injecting higher quality steam in EOR operations can result in a more efficient process, and yield higher oil production volumes due to the higher heat injected into a wellbore for the same amount of steam. 95% quality steam has higher heat content compared to 80% quality steam on a unit mass basis. This is because of 18% more latent heat of vaporization present in 95% quality steam compared to 80% quality steam at 1,500 psig. Specifically, 95% quality steam has 83.4 Btu/lb of higher heat content than 80% quality steam. This translates into an increase of 8% higher heat content for 95% quality steam.

Moreover, the amount of feedwater that is required for the same heat output will decrease with 95% quality steam. Because there is a lower liquid content associated with 95% quality steam, there will be a corresponding reduction in pumping and water treatment costs.

Additionally, when there is flow split in the piping system utilized to deliver the EOR steam to a formation, it is difficult to maintain the same steam quality through each branch of the piping system. Some piping branches will have higher quality steam (less water) and some will have lower quality (more water) steam. This results in an uneven flow distribution and significant variation in heat input among different formation injection points of the piping system. 95% quality steam will minimize this inherent problem associated with the distribution of wet steam in a split piping system. This distribution improvement is due to low liquid loading on higher quality steam.

Finally, regardless of the OTSG, there is a need to manage the liquid portion of the steam stream which exits the steam separator as saturated water. This saturated water, once it has been utilized to remove solids, must be disposed of. Because water disposal costs are often high and can decrease the cost effectiveness of EOR operations, one solution for disposal of this saturated water is to reintroduce it back into the steam stream that is to be injected into a wellbore. As noted above, steam from a steam separator is typically introduced into a superheater to produce superheated steam for injection into a wellbore. The effect of mixing at least a portion of the saturated water back into the superheated steam stream results in converting the superheated steam back into 95% quality steam. In the prior art, since it is in a liquid stated, the saturated water is often introduced directly into the flow path of the superheated steam stream in a desuperheater having nozzles through which the saturated water is sprayed. Typically, when the saturated water droplets come into contact with superheated steam (which is at a much higher temperature), the saturated water droplets evaporate instantaneously upon contact with superheated steam, resulting in precipitation of solids from saturated water. These solids often plug up the nozzles and cause scale formation in surrounding areas of desuperheater and piping.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION OF THE DISCLOSURE

Disclosed herein is a steam supply system for providing process steam of a desired quality for injection in a wellbore during enhanced oil recovery operations, wherein saturated condensate from a steam separator is cooled before mixing the subcooled condensate with superheated steam, where the degree of cooling is selected to prevent the subcooled condensate from immediately evaporating when mixed with the superheated steam. Specifically, the saturated condensate from a steam separator is introduced into a subcooler prior to introducing the condensate into a superheated steam stream. Using subcooled water spray instead of saturated water avoids the precipitation drawbacks of the prior art. Rather, the subcooled condensate permits a gradual transition period for subcooled water droplets to reach saturated state since the temperature of subcooled water droplets has to increase by almost 100° F. to reach saturation stage. The gradual increase in the subcooled water temperature helps to retain the solids in a dissolved state longer than the prior art, thereby minimizing precipitation of solids at the point of mixing, and in particular, precipitation at the nozzles. The foregoing permits the 20% condensate (80% quality steam) to be recycled through the subcooler and then converting 75% of the recycled condensate into steam by mixing it with the superheated steam with the ultimate goal being toc produce 95% or better quality process steam while avoiding plugging of spray nozzles and fouling of piping components. Moreover, by recycling such a large percentage of the saturated condensate, the amount of saturated condensate requiring disposal is minimized, thereby improving cost efficiencies.

Figure 1:
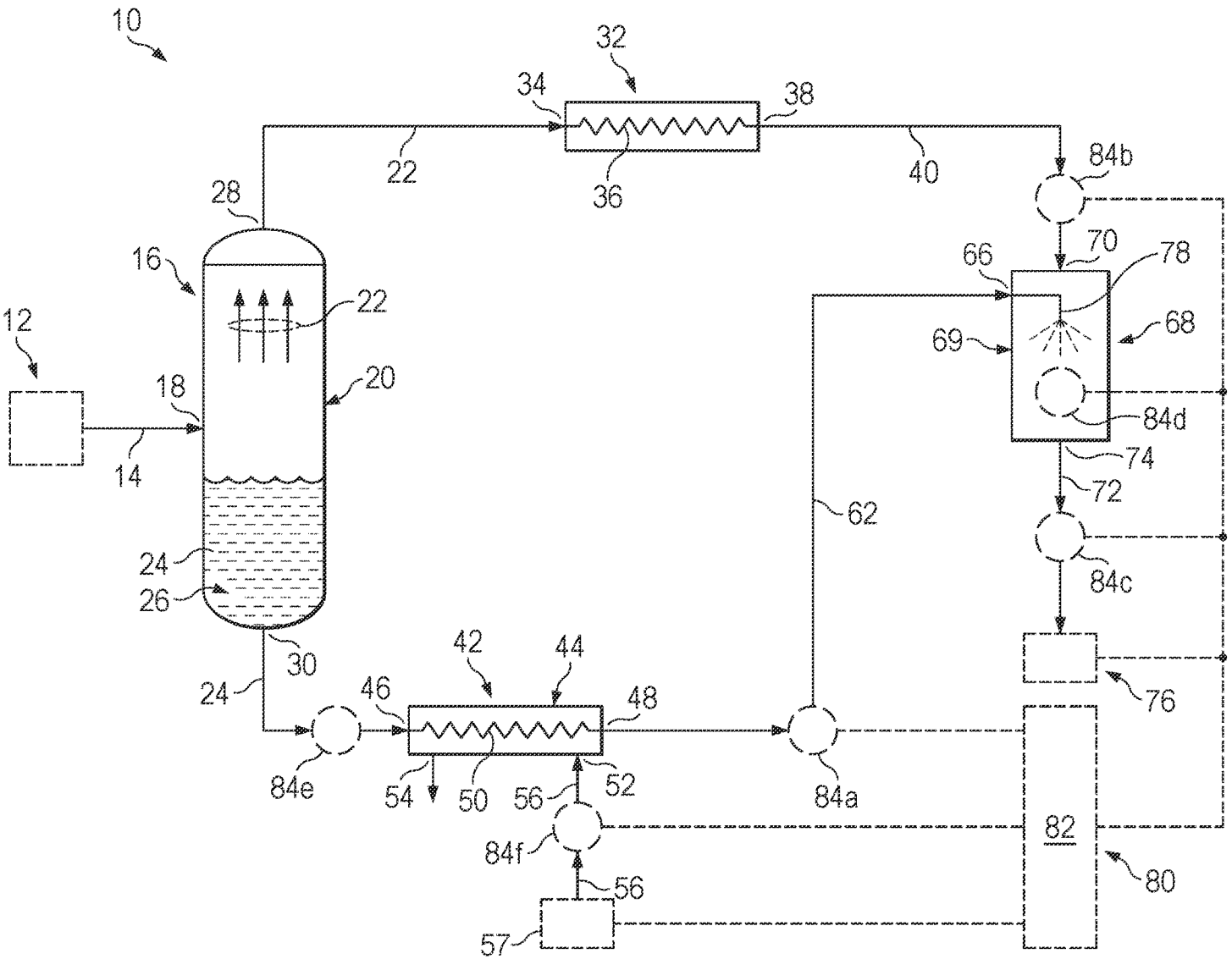
FIG. 1 is a schematic diagram of a steam generation system.

With reference to FIG. 1, a steam supply system 10 is shown and includes a steam source 12, a steam separator 16, a steam superheater 32, a subcooler 42 and a steam mixing vessel 68. Steam source 12 generates wet steam 14. Steam source 12 is in fluid communication with steam separator 16 having a separation vessel 20. Wet steam 14 is delivered to the steam separator 16 via a steam inlet 18 disposed in separation vessel 20. While steam source 12 is not limited to a particular system, in one or more embodiments, steam source 12 may be an OTSG such is described below with reference to FIG. 2. In other embodiments, steam source may be other types of steam generators, including but not limited to heat recovery steam generators (HRSGs), electric steam generators and the like. In any event, within separation vessel 20 of steam separator 16, dry saturated steam 22 separates from saturated condensate 24, with the saturated condensate 24 collecting in a lower portion 26 of separation vessel 20, and the dry saturated steam 22 passing through a steam outlet 28 within separation vessel 20. It will be appreciated that saturated condensate 24 includes retained water soluble solids in solution, and the saturated condensate 24 is utilized to remove these solids from the steam supply system 10, and in particular, the steam separator 16. As such, the saturated condensate 24 is removed from steam separator 16 through a condensate outlet 30 disposed within separation vessel 20.

Steam separator 16 is in fluid communication with superheater 32, allowing the dry saturated steam 22 exiting steam separator 16 to flow to superheater 32. Specifically, the steam outlet 28 of separation vessel 20 is in fluid communication with a steam inlet 34 of superheater 32. It will be appreciated that superheater 32 is not limited to any particular type of superheater, and may include radiant, convection, and separately fired superheaters. For purposes of the disclosure, while generally described in FIG. 1, superheater 32 is shown as a convection superheater in FIG. 2 as described below. Notwithstanding the foregoing, in one or more embodiments, superheater 32 may include a heat exchanger interface 36 to increase the temperature of dry saturated steam 22 introduced to superheater 32. For example, heat exchanger interface 36 may be superheater tubes exposed to convention or radiant heat transfer. In any event, dry saturated steam 22 entering superheater 32 is heated and exits superheater 32 via steam outlet 38 as superheated steam 40.

Separation vessel 20 is in fluid communication with subcooler 42, and in particular, condensate outlet 30 disposed within separation vessel 20 is in fluid communication with a saturated condensate inlet 46 of subcooler 42 to allow the saturated condensate 24 from steam separator 16 to flow to subcooler 42. As saturated condensate passes through subcooler 42 and exits subcooler 42 via condensate outlet 48, the saturated condensate is cooled. It will be appreciated that subcooler 42 is not limited to any particular type of subcooler. In some embodiments, subcooler 42 may utilize liquid cooling and includes a vessel 44 with a heat exchange interface 50 disposed in vessel 44 through which a cooling is directed. In one or more embodiments, heat exchange interface 50 may be a tube bundle within vessel 44. In any event, the saturated condensate inlet 46 and the subcooled condensate outlet 48 are in fluid communication with the heat exchange interface 50. Vessel 44 may include a cooling fluid inlet 52 and a cooling fluid outlet 54 to permit a cooling fluid 56 from a cooling fluid source 57 to circulate through vessel 44 and about heat exchange interface 50. While not limited to a particular type of fluid, in some embodiments, cooling fluid 56 is feedwater. Moreover, cooling fluid 56 may circulate in an open or closed loop through subcooler 42. In other embodiments, subcooler 42 may be air cooled, in which case vessel 44 may be open to allow air as cooling fluid 56 to pass across heat exchange interface 50. In any event, regardless of the method of heat transfer, saturated condensate 24 leaves subcooler 42 as a subcooled condensate 62. In one or more embodiments, vessel 44 may be elongated and substantially horizontal to increase residence time of saturated condensate passing through vessel 44.

The subcooled condensate 62 from subcooler 42 can then be mixed with superheated steam 40 from superheater 32 without the resultant scale formation prevalent in the prior art systems. In one or more embodiments, the subcooled condensate outlet 48 of subcooler 42 is in fluid communication with a subcooled condensate inlet 66 of steam mixing vessel 68. Steam mixing vessel 68 also include a superheated steam inlet 70 allowing a stream of superheated steam 40 to be passed through steam mixing vessel 68. Thus, the superheated steam outlet 38 of superheater 32 is in fluid communication with the superheated steam inlet 70 of steam mixing vessel 68. Because of the temperature of the subcooled condensate 62, the subcooled condensate 62 does not immediately evaporate when sprayed into the stream of superheated steam 40. Rather, the cooled nature of the subcooled condensate 62 results in a more gradual heating of the subcooled condensate 62 by the superheated steam 40 before the subcooled condensate 62 evaporates, resulting in a process steam 72. In one or more embodiments, the process steam 72 may be approximately 95% quality steam, while in other embodiments, the process steam 72 simply has a higher water content than the superheated steam, but a lower water content than the wet steam 14 originally introduced into the steam separator 16. Once the superheated steam 40 from superheater 32 is mixed with the subcooled condensate 62 of subcooler 42 to create process steam 72, the process steam 72 exits steam mixing vessel 68 via an outlet 74 for use with downstream equipment 76. In one or more embodiments, downstream equipment may be a wellbore tool 76 utilized to inject the steam into an oil and gas wellbore (not shown). However, in other embodiments, downstream equipment 76 may be other devices, such as a steam turbine for electricity generation, a steam engine, a steam reformer for producing syngas, cracking units, distillation units [other??]. For purposes of the disclosure, the steam supply system 10 will be described in terms of steam utilized in EOR operations.

More specifically, mixing of subcooled condensate 62 with superheated steam 40 within steam mixing vessel 68 occurs within a chamber 69 by spraying the subcooled condensate 62 into the superheated steam 40 stream via one or more nozzles 78 arranged within steam mixing vessel 68. Nozzles 78 are not limited to a particular device, but may be any device with an opening or aperture to allow subcooled condensate 62 to be introduced into chamber 69 for mixing with superheated stream 40. Because condensate 62 has been cooled, the subcooled condensate 62 does not immediately evaporate at nozzles 78, thus avoiding precipitation of solids on nozzle 78. As used herein, steam mixing vessel 68, which can also be referred to as a desuperheater, may be a chamber, enclosure, valve or other device that allows the subcooled condensate 62 to be introduced into a superheated steam 40 stream. It will be appreciated that while outlet 74 is in fluid communication with downstream equipment 76, various additional steam handling devices may be disposed therebetween to assist in handling of the process steam 72, including but not limited to steam pumps (not shown). Moreover, where downstream equipment 76 is a wellbore tool, the wellbore tool may be a drill string, a production string or any other downhole tool that can be positioned within a wellbore (not shown) to release process steam 72 therein. As noted above, in some embodiments, the process steam 72 need not be injected into a wellbore at all, but may be used for other purposes consistent with the need for steam of the quality resulting from steam supply system 10.

In one or more embodiments, a control system 80 may be utilized to control the quality and temperature of process steam 72 exiting steam mixing vessel 68 by adjust the temperature from a first temperature T1 to a lower second temperature T2 to which the saturated condensate 24 is cooled in subcooler 42. Control system 80 includes one or more sensors 84 and a central processing unit ("CPU") 82 programmed to monitor one or more conditions of fluid flow within steam supply system 10 and adjust fluid flow of one or more of the cooling fluid 56, the subcooled condensate 62, the superheated steam 40 and the saturated condensate 24 to achieve a desired output for process steam 72. In the illustrated embodiment, CPU 82 may monitor a condition of subcooled condensate 62 with a sensor 84*a*. CPU 82 may monitor a condition of superheated steam 40 with a sensor 84*b*. CPU 82 may monitor a condition of process steam 72 with a sensor 84*c*. Likewise, CPU 82 may monitor a condition within the steam mixing vessel 68 with a sensor 84*d*. CPU 82 may monitor a condition of saturated condensate 24 at the inlet 46 of the subcooler 42 with a sensor 84*c*. Finally, CPU 82 may monitor a condition of the cooling fluid 56 with sensor 84*f*. Measured conditions may include but are not limited to fluid temperature, pressure, flow and fluid quality such as water content of steam. Sensors 84 are likewise not limited to particular types of sensors. In one or more embodiments, a sensor, such as 84*b*, may include multiple sensors to measure flow, pressure, quality and temperature of a fluid. In any event, based on measured conditions by one or more of the sensors 84, in one or more embodiments, CPU 82 may adjust cooling fluid 56 flow rate from cooling fluid source 57 to achieve a desired condition of process steam 72. By adjusting the flow rate of cooling fluid 56, the temperature T2 can be controlled. In one or more other embodiments, CPU 82 may adjust subcooler 42 to achieve a desired condition of process steam 72. For example, the quality of process steam 72 may be decreased by adjusting subcooler 42 to provide increased cooling to saturated condensate 24 by increasing the flow rate of the cooling fluid 56 passing through subcooler 42. In this regard, subcooler 42 is adjustable to achieve a desired condition of process steam 72. In one or more embodiments, the required temperature of subcooled condensate 62 to achieve a particular result is calculated by heat and mass balance (HMB) across the steam mixing vessel 68. In such case, it will be appreciated that condensate flow and pressure as measured by one or more sensors 84 may be utilized by control system 80 for this purpose. Moreover, it will be appreciated that steam quality must be verified by control system 80 through HMB analysis utilizing sensors 84 since steam saturation temperature will be the same whether the steam quality is 1% or 99.99%. More specifically, control system 80 can be utilized to maintain a predetermined final steam quality for process steam 72. This is accomplished by adjusting the degree of subcooling for saturated condensate 24 since its flow rate through subcooler 42 may be fixed. The temperature of saturated condensate 24 resulting in subcooled condensate 62 may be controlled by modulating the cooling flud 56 passing through vessel 44 of subcooler 42, or by modulating the flow of saturated condensate 24 through subcooler 42 or both. Moreover, control system 80 can likewise adjust the flow rate of subcooled condensate 62 introduced into chamber 69 in order to control the water content of process steam 72. An additional advantage utilizing subcooled condensate 62 as described is that it provides the control flexibility for precise control of final steam quality. Thus, optimum final steam quality can be calculated based on feedwater analysis and the flow of feedwater through subcooler 42 can be adjusted accordingly. Control system 80 may include one or more pumps, control valves and bypass valves (not shown) used to control the flow of the fluids described above, such as a cooling fluid pump or a subcooled condensate pump.

Figure 2:
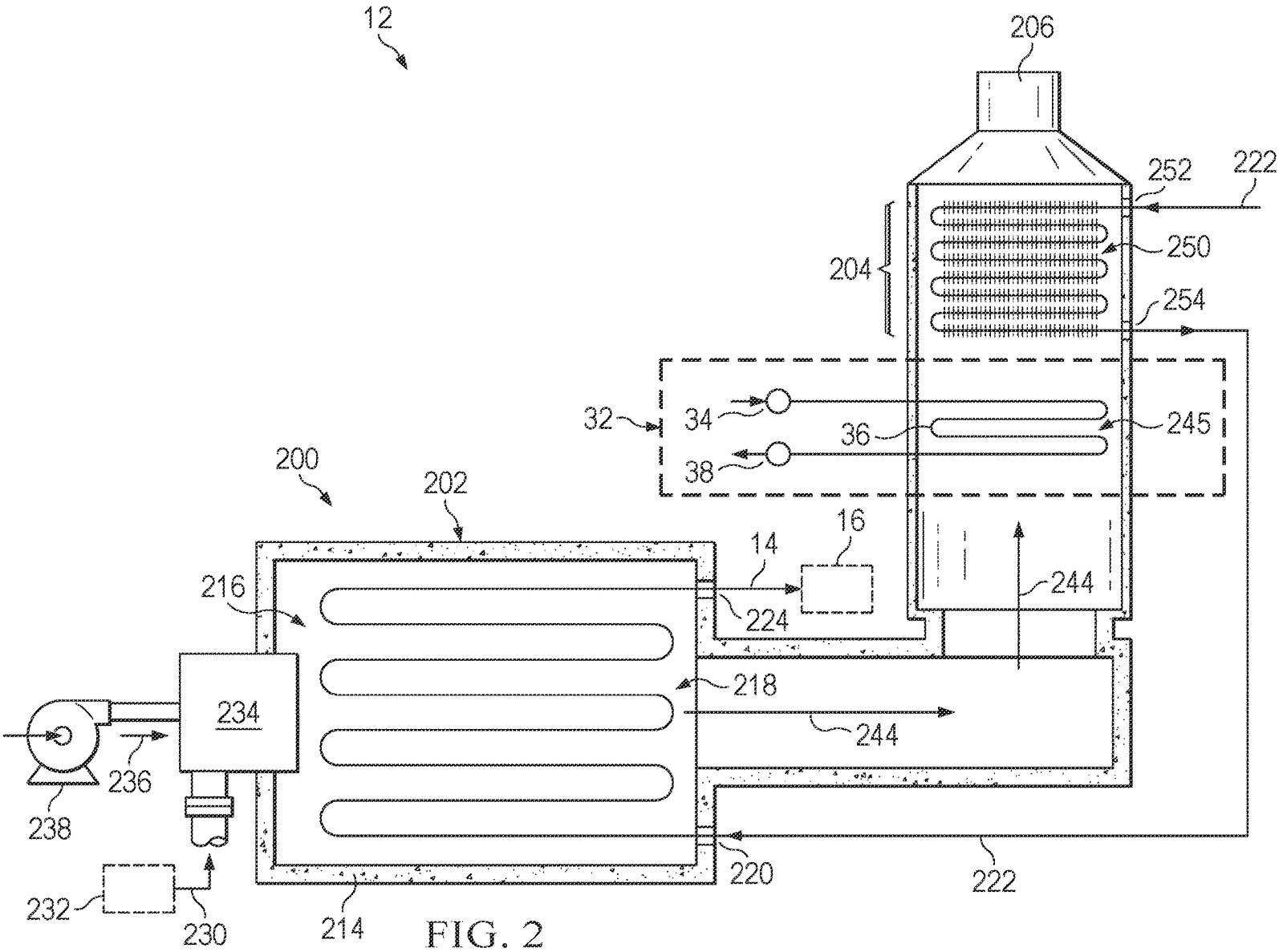
FIG. 2 is a schematic diagram of an OTSG utilized as a component of the steam generation system.

Turning to FIG. 2, one embodiment of a steam source 12 is shown. In this embodiment, steam source 12 is depicted as a OTSG 200 having radiant section 202, a convection section 204 and a flue gas stack 206. Radiant section 202 is formed of an enclosure 214 having an interior 216 with a feedwater tube bank 218 disposed therein. Tube bank 218 includes a feedwater inlet 220 to provides feedwater 222 to tube bank 218, and tube bank 218 includes a wet steam outlet 224 that is in fluid communication with steam inlet 18 of steam separator 16 (see FIG. 1) to deliver wet steam 14 to steam separator 16. A fuel source 232, provides fuel 230, such as natural gas, to a burner 234 where air 236 is introduced into burner 234 by a blower 238. Burner 234 is disposed to deliver heat to the interior 216 of radiant section 202, converting the feedwater 222 within tube bank 218 into wet steam 14.

In the illustrated embodiment, superheater 32 (see also FIG. 1), is integrally formed as part of the convection section 204 of OTSG 200. Specifically, convection section 204 includes an interior 242 through which flue gas 244 from radiant section 202 is directed before passing from OTSG 200 through a flue gas stack 206. The heat exchange interface 36 of superheater 32 is disposed within convection section 204 to heat dry saturated steam 22 entering superheater 32 via steam inlet 34. Specifically, in one or more embodiments, heat exchange interface 36 is a tube bank 245 disposed within the interior 242 of convection section 204 so that flue gas 244 passing therethrough can heat the dry saturated steam 22 within tube bank 245 before it passes through steam outlet 38 as superheated steam 40.

Although not necessary, in one or more embodiments, feedwater 222 may be preheated in convection section 204 prior to introduction into feedwater tube bank 218. In the illustrated embodiment, a preheater heat exchanger 250 may be disposed in the interior 242 of convection section 204. Preheater heat exchanger 250 includes a feedwater inlet 252 and a feedwater outlet 254, where feedwater outlet 254 is in fluid communication with feedwater inlet 220 of feedwater tube bank 218. Preheater heat exchanger 250 may be a tube bank as shown. In any event, in addition to heating dry saturated steam 22 passing through superheater 32, flue gas 244 flowing through convection section 204 to flue gas stack 206 also preheats feedwater 222 in tube bank 250 prior to introduction of the feedwater 222 into the radiant section 202 of OTSG 200.

Figure 3:
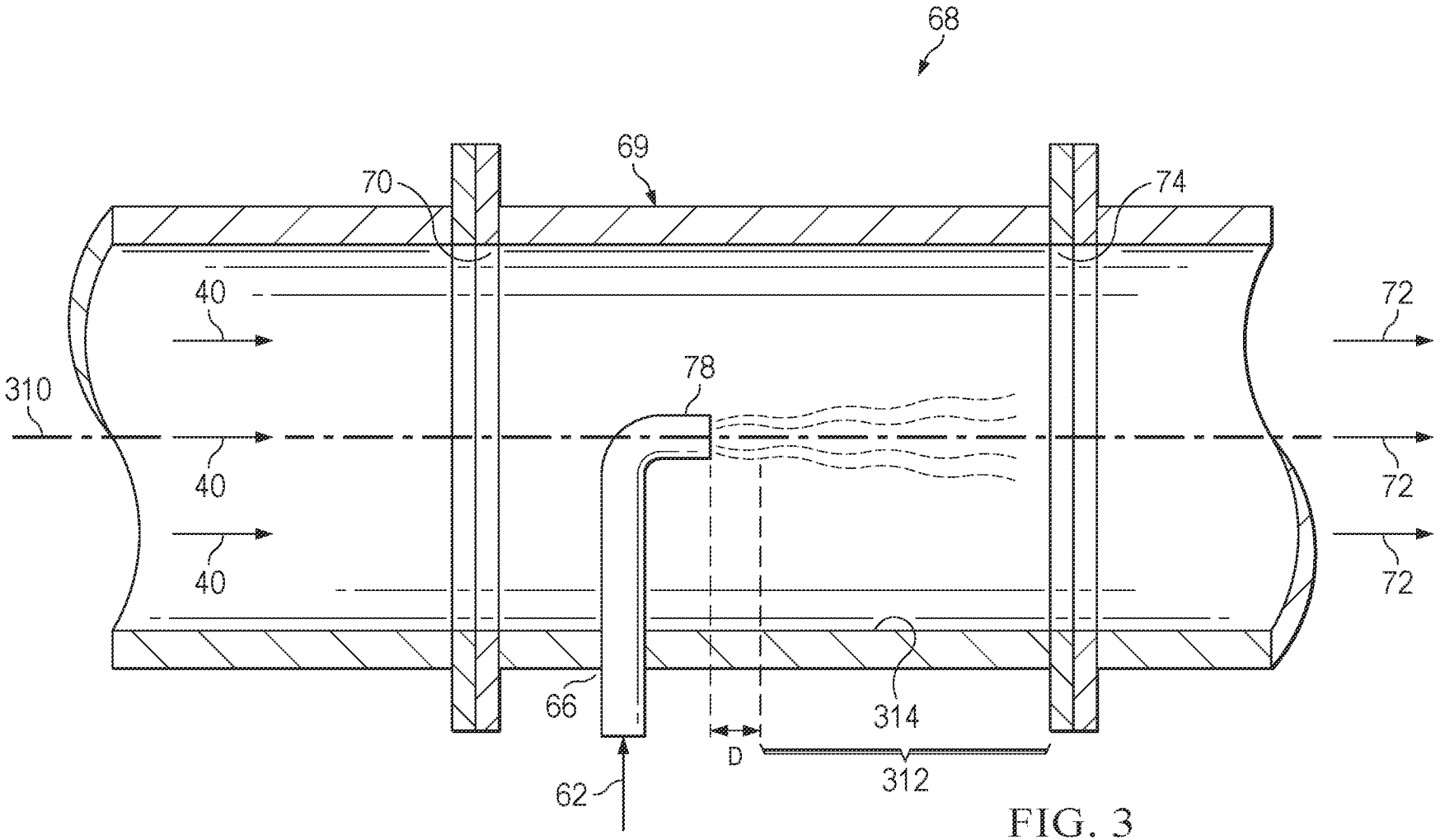
FIG. 3 is a mixer assembly for mixing superheated steam with subcooled condensate.

With reference to FIG. 3, one embodiment of steam mixing vessel 68, or de-superheater, is shown in more detail to illustrate introduction of subcooled condensate 62 into a stream of superheated steam 40 so as to minimize formation of scale in preparation of process steam 72. As described above, steam mixing vessel 68 includes a superheated steam inlet 70 through which superheated steam 40 from superheater 32 (not shown) enters chamber 69 of steam mixing vessel 68. Likewise, steam mixing vessel 68 includes subcooled condensate inlet 66 through which subcooled condensate 62 from subcooler 42 (not shown) enters chamber 69. In one or more embodiments, chamber 69 may be elongated and extends along an axis 310 centrally defined within chamber 69. In this regard, chamber 69 may extend linearly between steam inlet 70 and outlet 74 to promote generally laminar flow of the superheated steam therethrough. Superheated steam 40 entering chamber 69 is made to flow generally laminarly through chamber 69 in a first direction, i.e., towards outlet 74, that is generally parallel with axis 310. In one or more embodiments, nozzle 78 is disposed in chamber 69 along axis 310 and oriented to release subcooled condensate 62 in the first direction, i.e., towards outlet 74, so that subcooled condensate 62 exiting nozzle 78 is released centrally within chamber 69 and likewise flows generally laminarly through chamber 69 and parallel with axis 310. In other embodiments, nozzle 78 may not be positioned along axis 310, but is still disposed so that subcooled condensate 62 exiting nozzle 78 is released within chamber 69 so that the subcooled condensate 62 flows generally laminarly through chamber 69 and parallel with axis 310. It will be appreciated that in some embodiments, a plurality of nozzles 78 as described may be positioned to release subcooled condensate 62 within steam mixing vessel 68, which plurality of nozzles 78 may be symmetrically arranged about axis 310. In any event, because of the lower temperature of subcooled condensate 62, rather than evaporating at nozzle 78 upon release into chamber 69, the subcooled condensate 62 gradually evaporates in the presence of the superheated steam 40 in a transition zone 312 formed downstream of nozzle 78 and extending towards the outlet 74 of steam mixing vessel 68, thereby converting the superheated steam 40 into process steam 72 as the fluids flow along the transition zone 312. In some embodiments, the transition zone 312 may be spaced apart from nozzle 78 a distance D. In one or more embodiments, the subcooled condensate begins to evaporate at a point spaced apart from the nozzles 78. In addition to minimizing scale formation at nozzle 78, the above-described unidirectional arrangement of flow of fluids also minimizes scale formation on the walls 314 of chamber 69 and thermal shock that to walls 314. The evaporation process is gradual since the subcooled condensate 62 first must reach saturation state prior to evaporation. In one or more embodiments, chamber 69 may be formed of a conduit, which may be round or polygonal in cross-sectional shape.

Figure 4:
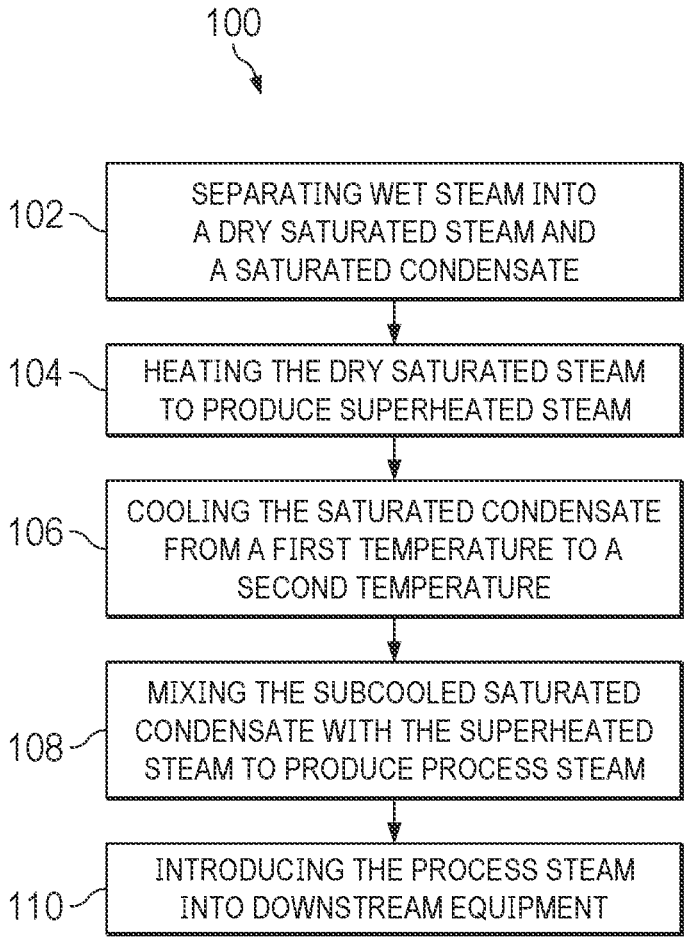
FIG. 4 is a flow chart of a method for supplying process steam.

FIG. 4 illustrates a method 100 for supplying steam. In a step 102 of method 100, wet steam 14 is separated into a dry saturated steam 22 and a saturated condensate 24. The wet steam 14 may be produced from a steam source 12, such as the OTSG 200 illustrated in FIG. 2. In this regard, steam source 12 may convert feedwater 222 into wet steam 14 utilizing radiant heat. Moreover, in some embodiments, the feedwater 222 may be preheated utilizing flue gas 244 from OTSG 200. In any event, the wet steam 14 generated by steam source 12 may be approximately 80% quality. Moreover, the wet steam 14 may include solids dissolved in the wet steam 14. Thus, in step 102, the dissolved solids remain in solution in the saturated condensate 24 so that the dissolved solids can be removed for disposal. Step 102 may occur in a steam separator 16. In some embodiments, the temperature of the wet steam 14 may be approximately 597° F., while the temperature of the dry saturated steam 22 may be approximately 597° F. Finally, the temperature of the saturated condensate 24 may be approximately 597° F.

In step 104, the dry saturated steam 22 is heated to produce superheated steam 40. In this step 104, the dry saturated steam 22 may be passed through a superheater 32. In one or more embodiments, the heat is transferred by convection and radiation to the dry saturated steam 22 via flue gas resulting from the production of the wet steam 14. In any event, the temperature of the superheated steam 40 may be approximately 723° F.

In step 106, the saturated condensate 24 is cooled from a first temperature T1 to a second temperature T2 that is lower than the first temperature T1. In one or more embodiments, the first temperature T1 may be approximately 597° F., while the second temperature T2 may be in the range of 497° F. As noted above, the target temperature T2 may be selected to achieve a desired quality of steam for process steam 72. For example, if the process steam 72 is to have a 95% quality, the temperature T2 is approximately 497° F. Step 106 may be accomplished by passing the saturated condensate 24 through a subcooler 42 where a cooling fluid 56 is utilized to remove heat from the saturated condensate 24. In some embodiments, the cooling fluid 56 may be feed water or another liquid, while in other embodiments, the cooling fluid 56 may be air or other gas passing over tubes through which the saturated condensate 24 flows. In this regard, the degree of cooling of saturated condensate 24 can be altered by adjusting the flow rate of the cooling fluid 56 flowing through the subcooler 42. Thus, in some embodiments, the temperatures T1 can be measured by sensor 84*c* and the temperature T2 can be measured by sensor 84*a*, and the flow rate of cooling fluid 56 measured by sensor 84*f* can be adjusted. In some embodiments, the temperature of the saturated condensate 24 is cooled by at least approximately 100° F. Moreover the degree of cooling may be selected based on the desired % quality of the process steam to be produced. Thus, in some embodiments, process steam 72 may have first % quality, and upon adjustment of the flow rate of cooling fluid 56, the % quality of the process steam 72 can be altered to a second % quality that is different than the first % quality. In some embodiments, the cooling fluid is feedwater and has an initial temperature of approximately 85° F. upon introduction into subcooler 42 and discharge temperature of approximately 111° F. As such, the temperature of subcooled condensate 62 can be controlled by modulating the cooling fluid 56 bypass across the subcooler 42. An additional advantage with subcooled water as described is that the subcooler 42 permits control flexibility for precise control of final process steam quality. It will be appreciated that unless otherwise noted specific temperatures as used herein are for illustrative purposes only and may represent an approximate temperature or temperature range.

In step 108, the subcooled condensate 62 is mixed with the superheated steam 40 to produce process steam 72. In one or more embodiments, the process steam 72 has a quality of approximately 95%, while in other embodiments, the process steam has a quality greater than 87%. In one or more embodiments, mixing occurs by introducing the subcooled condensate 62 into a stream of superheated steam 40. In this regard, the subcooled condensate 62 is released into the superheated steam 40 stream so as to flow parallel with the superheated steam 40 stream. The subcooled condensate 62 may be sprayed in the direction of flow of the superheated steam stream. In step 108, over a transition zone 312, the subcooled condensate 62 gradually evaporates. The evaporation process is gradual since the subcooled condensate 62 first must reach saturation state prior to evaporation in the presence of the superheated steam. In some embodiments, the subcooled condensate 62 is released into the superheated steam stream as described above along a central point of the superheated steam stream (as opposed to the boundaries of the flow stream) so as to minimizes scale formation on the walls 314 of chamber 69 in which mixing occurs.

In step 110, the process steam 72 is then introduced into downstream equipment for further use. Thus, in one or more embodiments, step 110 may include injecting the process stream into a wellbore for EOR operations. In one or more embodiments, step 110 may include passing the process steam 72 through a steam turbine for electricity generation. In one or more embodiments, step 110 may include utilizing the process steam 72 to drive a steam engine. In one or more embodiments, step 110 may include introducing the process steam 72 into a steam reformer to produce syngas. In one or more embodiments, step 110 may include utilizing the process steam 72 for the production of chemicals in cracking units or distillation units.

In summary, it will be appreciated that the foregoing steam supply system 10 increases process efficiency by increasing oil production by about 8 percent using the same amount of steam as prior art steam injection systems. This is because of 8% more thermal energy is present in 95% quality steam than 80% quality steam. Moreover, the amount of feedwater that is required for the same heat output will be 8% less with 95% quality steam. This results in a corresponding decrease in pumping HP and water treatment costs.

Although various embodiments have been shown and described, the disclosure is not limited to such embodiments and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

What is claimed is:

1. A method for supplying steam comprising
separating wet steam into dry saturated steam and saturated condensate;
heating the dry saturated steam to produce superheated steam;
cooling the saturated condensate from a first temperature to a second temperature lower than the first temperature to produce cooled condensate; and
mixing the cooled condensate with the superheated steam to produce process steam with a first % quality.

2. The method of claim 1, wherein the difference between the first temperature and the second temperature is at least 100° F.

3. The method of claim 1, further comprising injecting the process steam into a wellbore.

4. The method of claim 1, wherein cooling comprises adjusting the flow rate of a cooling fluid.

5. The method of claim 4, wherein adjusting the flow rate results in process steam with a second % quality that is different than the first % quality.

6. The method of claim 5, further comprising measuring a condition of the process steam, measuring the temperature of the saturated condensate and measuring the temperature of the subcooled condensate.

7. The method of claim 4, further comprising calculating the heat and mass balance (HMB) of superheated steam compared to the process steam, and based on the calculated HMB, adjusting the flow rate of the cooling fluid based on the calculated HMB.

8. The method of claim 1, wherein the step of mixing comprises establishing flow of the superheated steam in a first direction; and spraying the subcooled condensate in the direction of flow of the superheated steam stream.

9. A method for injecting steam into a wellbore
separating wet steam with a first % quality into a dry saturated steam and a saturated condensate;
superheating the dry saturated steam to produce superheated steam;
cooling the saturated condensate from a first temperature to a second temperature lower than the first temperature to produced cooled condensate;
mixing the cooled condensate with the superheated steam to produce process steam with a second % quality higher than the first % quality; and
injecting the process steam into a wellbore.

10. The method of claim 9, wherein the difference between the first temperature and the second temperature is at least 100° F.

11. The method of claim 10, wherein cooling comprises adjusting the flow rate of a cooling fluid.

12. The method of claim 11, wherein adjusting the flow rate results in process steam with the second % quality.

13. The method of claim 12, further comprising calculating the heat and mass balance (HMB) of superheated steam compared to the process steam, and based on the calculated HMB, adjusting the flow rate of the cooling fluid based on the calculated HMB.

14. The method of claim 9, wherein the step of mixing comprises establishing flow of the superheated steam in a first direction; and spraying the subcooled condensate in the direction of flow of the superheated steam stream, and gradually evaporating the subcooled condensate.

15. The method of claim 14, wherein evaporation of the subcooled condensate occurs at a point spaced apart from where the subcooled condensate is sprayed.

16. A method for supplying steam comprising separating wet steam into dry saturated steam and saturated condensate;

heating the dry saturated steam to produce superheated steam;

cooling the saturated condensate from a first temperature to a second temperature lower than the first temperature to produce cooled condensate; and introducing the cooled condensate into a stream of the superheated steam, wherein the second temperature is selected so that evaporation of the cooled condensate in the superheated steam stream occurs downstream of the point where the cooled condensate is introduced into the stream of superheated steam.

* * * * *